US005287589A

United States Patent [19]

Hughes

[11] Patent Number: 5,287,589

[45] Date of Patent: Feb. 22, 1994

[54] SELF-CONTAINED CLEANING AND RETRIEVAL APPARATUS

[75] Inventor: Joel Hughes, Wilmington, N.C.

[73] Assignee: Container Products Corp., Wilmington, N.C.

[21] Appl. No.: 937,147

[22] Filed: Aug. 31, 1992

[51] Int. Cl.[5] ..... A47L 7/00

[52] U.S. Cl. ..... 15/321; 15/340.1

[58] Field of Search ..... 15/321, 340.1

[56] References Cited

U.S. PATENT DOCUMENTS

| | | | |
|---|---|---|---|
| 3,842,461 | 10/1974 | Wurster | 15/340.1 X |
| 4,151,627 | 5/1979 | Wisdom | 15/321 |
| 4,244,079 | 1/1981 | Bane | 15/340.1 X |
| 4,284,127 | 8/1981 | Collier et al. | 15/321 X |
| 4,336,627 | 6/1982 | Bascus | 15/321 |
| 4,443,909 | 4/1984 | Cameron | 15/321 X |
| 4,475,264 | 10/1984 | Schulz | 15/340.1 X |
| 4,580,309 | 4/1986 | Ogden | 15/321 X |
| 4,862,551 | 9/1989 | Martinez et al. | 15/340.1 X |

*Primary Examiner*—Chris K. Moore

[57] ABSTRACT

A mobile, self-contained, environmentally safe, cleaning apparatus, including a supply of recycleable cleaning fluids and devices for heating, filtering and pressurizing such fluids for removing, capturing and packaging for safe disposal oils, dyes, fibers, lead paint and contaminated hazardous wastes, with the apparatus equipped with a water tank, a liquid ring pump adapted to create a wet vacuum recovery system, a water heater, a waste particle/liquid separator, a demister filter, and a retractable combined fluid supply and vacuum recovery umbilical cord for attachment to external remote cleaning devices.

17 Claims, 7 Drawing Sheets

FIG. 1
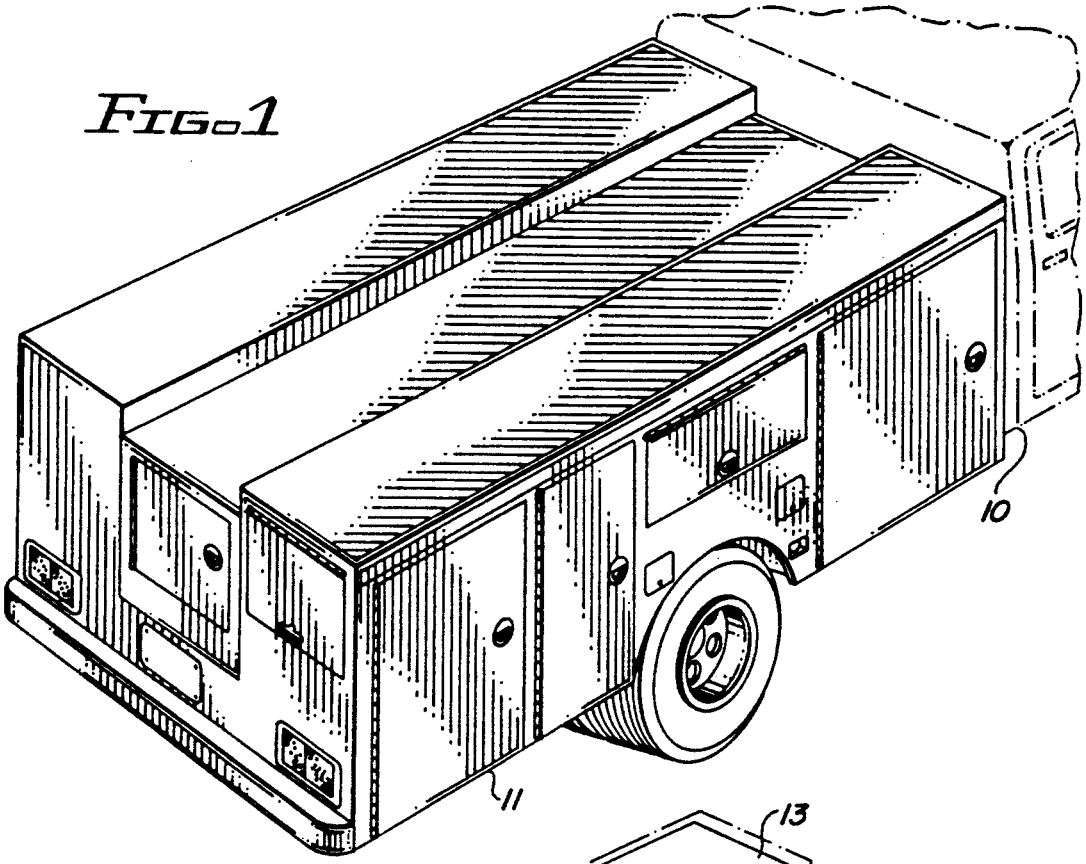
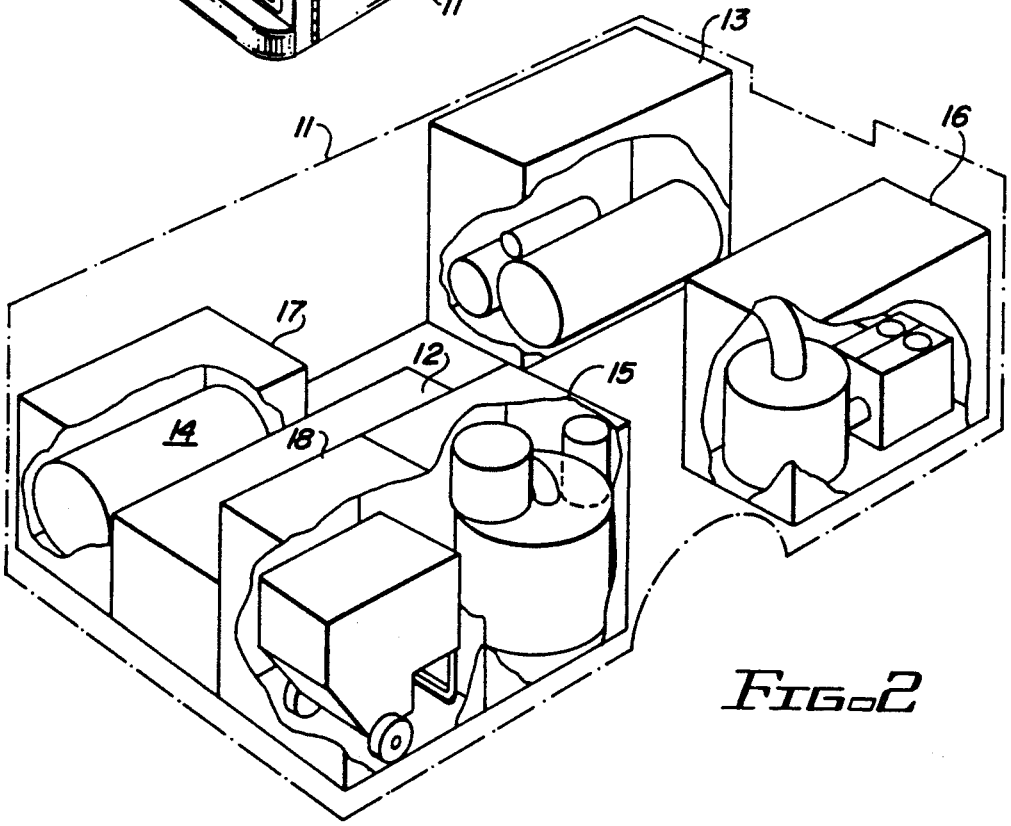
FIG. 2

FIG. 7
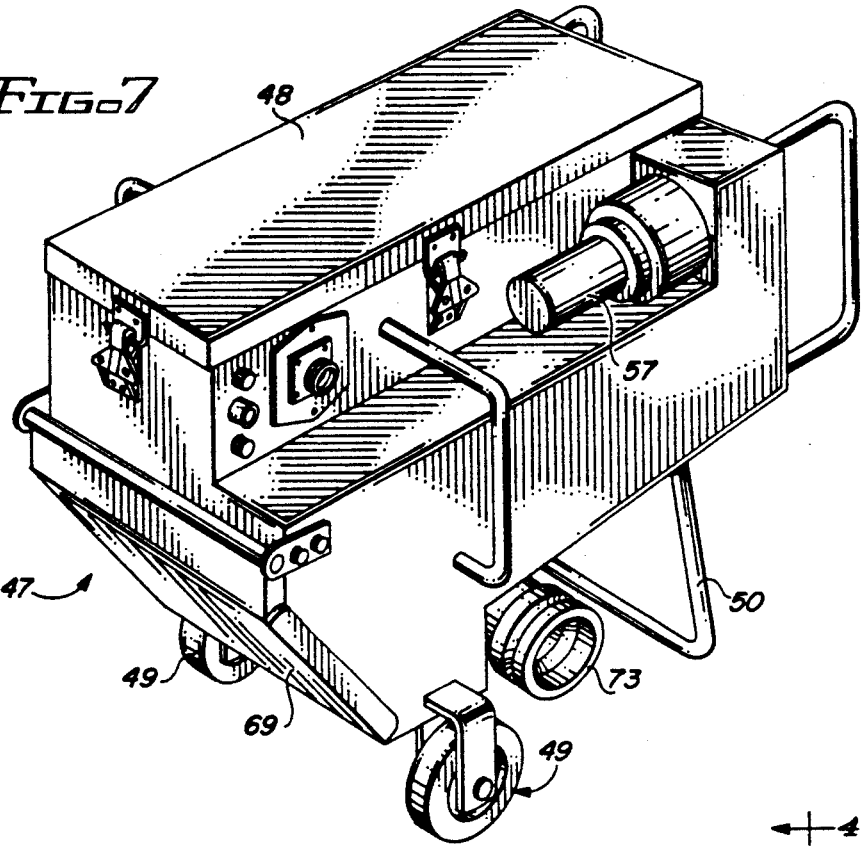
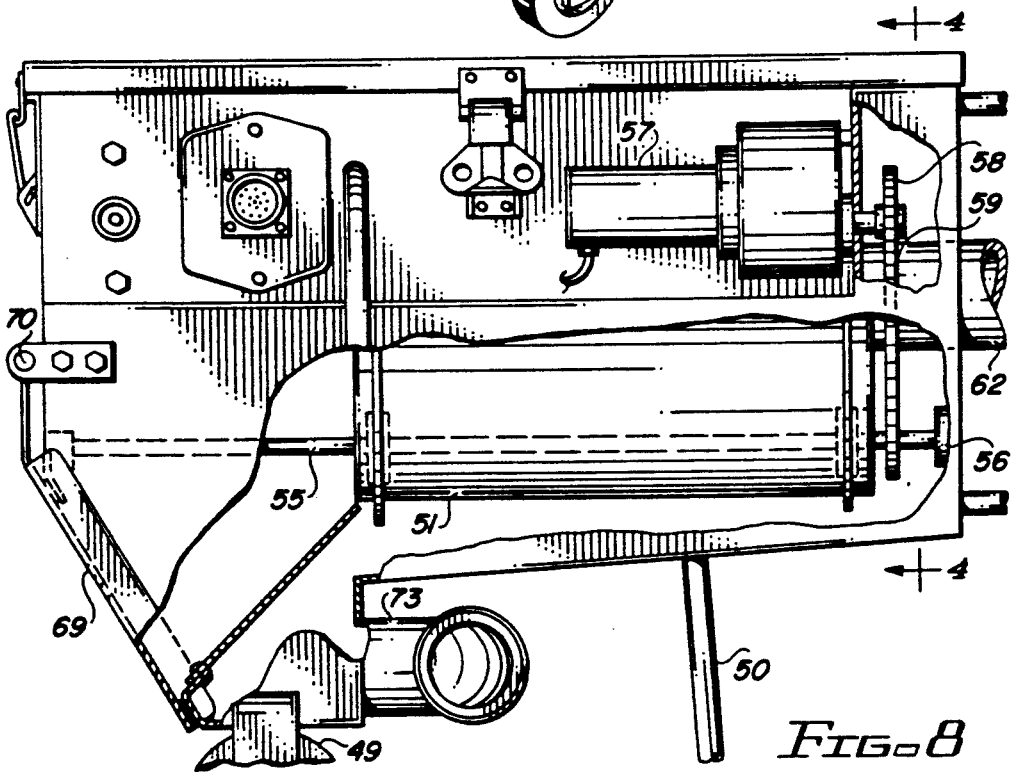
FIG. 8

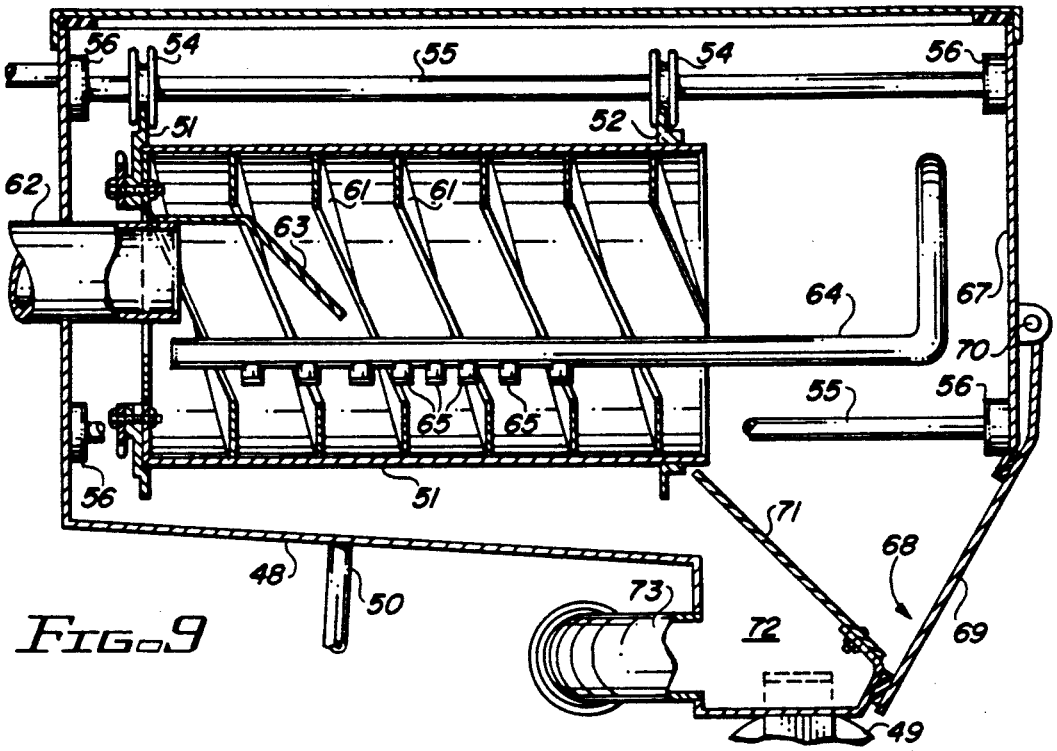
FIG. 9
FIG. 10
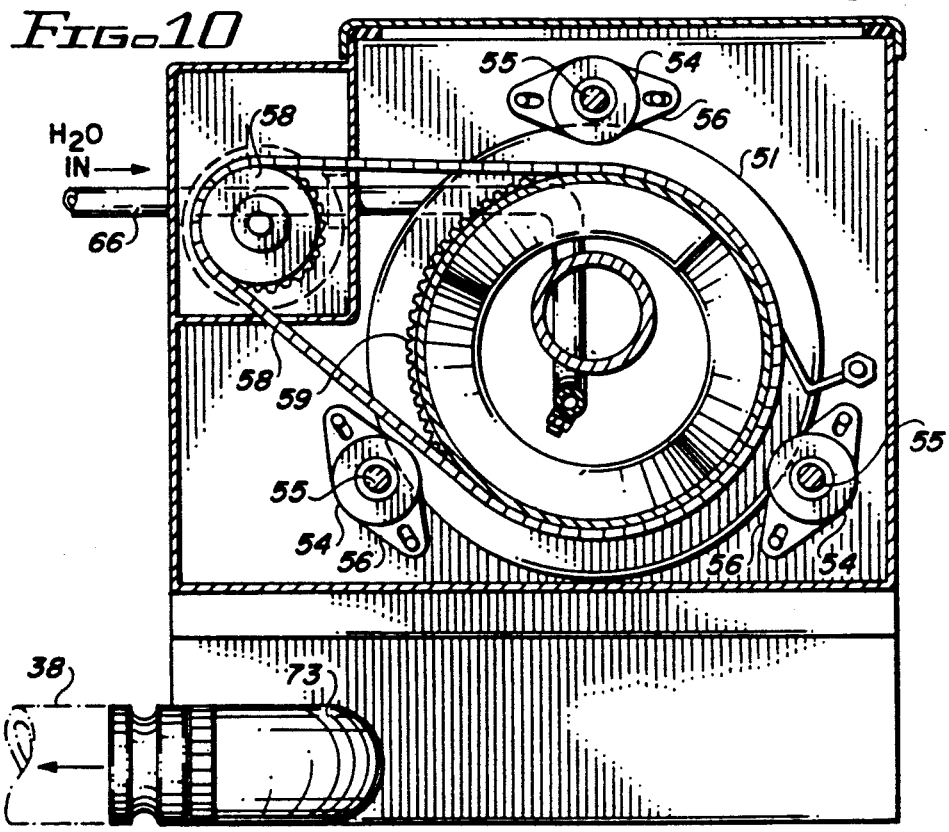

SELF-CONTAINED CLEANING AND RETRIEVAL APPARATUS

FIELD OF INVENTION

Many cleaning apparatuses have been developed for various cleaning purposes, with the apparatuses being capable of being transported to the work site in trucks or vans.

In these prior apparatuses their main power source is the internal combustion engine of the truck which also provides a housing for the cleaning fluid tank and the recovered spent fluid. Such apparatuses being disclosed as for example in U.S. Pat. No. 4,154,578, dated May 15, 1978.

A mobile apparatus wherein the cleaning fluid is heated through a heat exchange associated with the vehicle engine is disclosed in U.S. Pat. No. 4,109,340, dated Aug. 29, 1978; and variations thereof are disclosed in U.S. Pat. No. 2,555,822, dated Jun. 5, 1951.

The usefulness of these prior mobile cleaning apparatuses necessitates an independent source and supply of both electrical power and replacement cleaning fluids. These requirements restrict their use in remote areas where the external source and supply of electricity and liquids are unavailable. There is no means of recirculating the spent fluids through particle and liquid separators as well as filters so that such recovered fluids can be re-employed in a continuous independent cleaning and waste containment operation.

SUMMARY OF THE INVENTION

The present invention relates to a self-contained, automated cleaning and retrieval apparatus providing cooperative components whereby a remote spray/-vacuum cleaning tool dispenses a super heated pressurized fluid spray, and/or a combination liquid/abrasive medium, onto a surface to be cleaned or decontaminated, together with a simultaneous wet/vacuum recovery of the sprayed fluid and removed contaminated wastes from the surface being cleaned. The recovered contaminated fluid after being subject to moisture and particle separation and filtering is recycled for continuous use, with the recovered contaminated waste being contained for proper disposal.

The apparatus may include a fixed or mobile platform. As illustrated the platform is mounted upon a truck frame that supports the fluid tank, the heating and pressurizing system, the vacuum creating system.. and a generator for the necessary electrical power, and is compartmentized for the storage of job required cleaning tools. The power source for the generator may be a standard power take off arrangement operable in conjunction with the vehicle engine or it may include a hydraulic pumping system having in association therewith separate hydraulic motors for operating the selective power driven elements.

Another object of the present invention is to provide a self-contained automated retrieval cleaning apparatus which in use provides total environmental control of the material being removed.

Yet another object of the present invention is to provide a self-contained automated retrieval cleaning apparatus that includes a wet/vacuum recovery system which recovers the spent cleaning fluids as well as the contaminated material for filtering and recirculation of the cleaning fluids for continuous re-use so as to minimize waste volume.

Still another object of the invention is to provide a system which produces a super heated liquid spray cleaning action, having a higher degree of temperature than standard steam cleaners, with the heated fluid dispensed with the blast impact of pressure washers.

The cleaning and retrieval operation of the present invention includes the recovery of solid waste as well as the super heated cleaning fluids leaving no residue contamination.

The apparatus of the invention provides a powerful wet/dry vacuum system for recovery of the spent cleaning fluids as well as the unwanted contaminated wastes for direct containment of the waste in suitable disposable containers, without disrupting the continuing operation of the apparatus.

BRIEF DESCRIPTION OF THE DRAWINGS

The invention will best understood by reference to the accompanying drawings which illustrate the preferred form of construction and arrangement of parts by which the objects of the invention are achieved and in which;

FIG. 1 is a fragmentary perspective view of the self-contained mobile vehicle containing the invention;

FIG. 2 is a schematic view of the compartmentized arrangement of the cooperative elements of the invention;

FIG. 7 is a perspective view of the remote rock cleaner of this invention;

FIG. 8 is a fragmentary side elevational view of the rock cleaner;

FIG. 9 is a detailed side sectional view of the rock cleaner;

FIG. 10 is a detailed section end view of the rock cleaner of this invention;

DETAILED DESCRIPTION OF THE INVENTION

Figure 3:
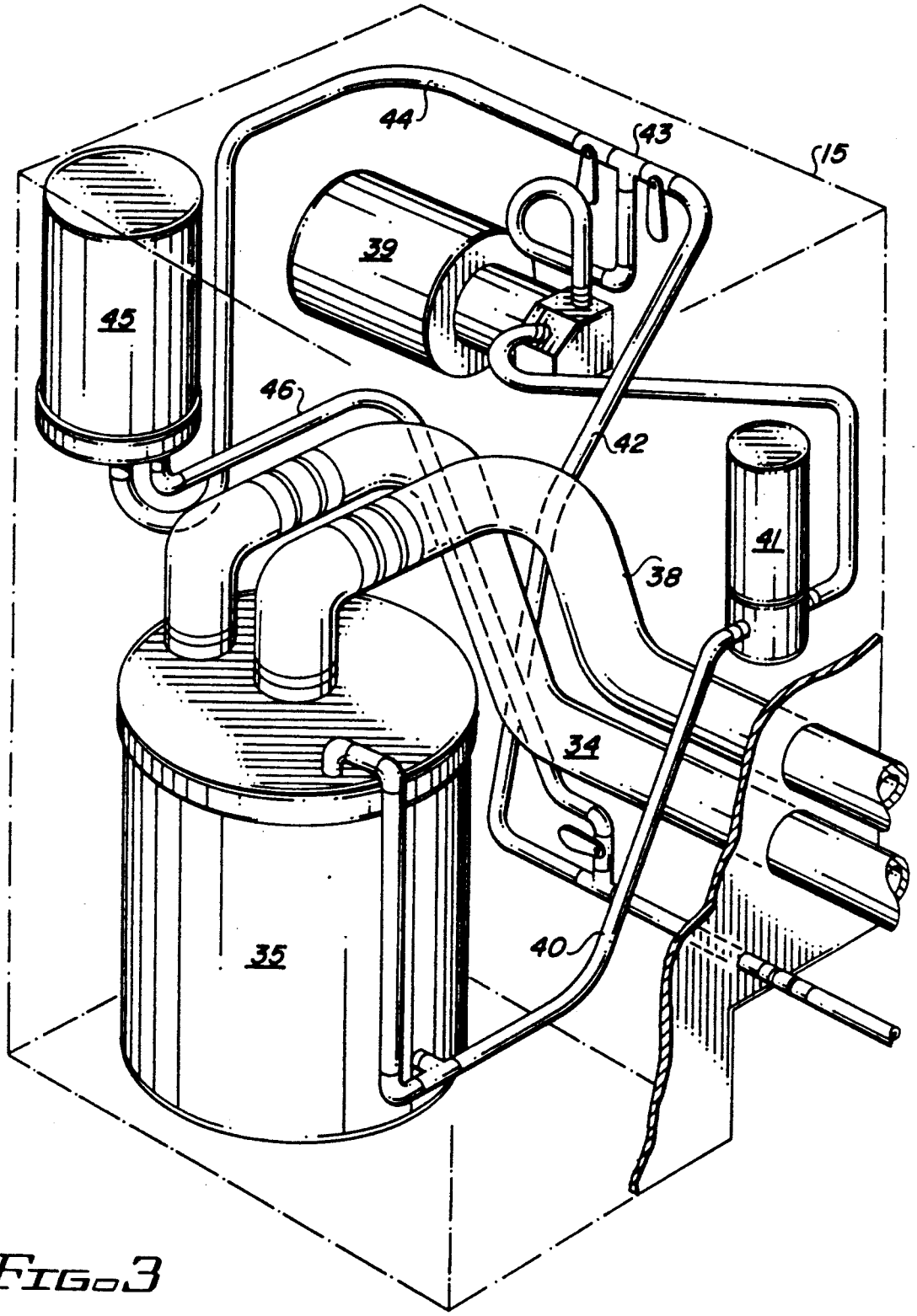
FIG. 3 is a perspective view of the elements contained in the liquid separator compartment.

This invention is a totally self-contained environmental safe cleaning apparatus. The apparatus may be carried on a platform or mounted upon a mobile truck bed 10 as illustrated in FIG. 1. In either environment the apparatus consists oil a compartmentalized body 11, such as is perspectively shown in FIGS. 1 and 2.

Referring to FIG. 2 there is schematically illustrated the relationship of the inter-connected compartments wherein compartment 12 is identified with a liquid supply tank; compartment 13 houses the main liquid circulating pump and super heater as well as an initial filter between the tank and the pump; compartment 15 encloses the liquid/particle filtering system, while compartment 16 holds the liquid ring vacuum pump and its liquid supply tank.

When the power driven elements of the cleaning and retrieving system requires an electrical power source compartment 17 will contain a generator 14.

The vehicle body 11 also provides a compartment 18 for the housing of auxiliary remote cleaning tools such as the rock cleaner and abrasive blast cleaner.

Figure 4:
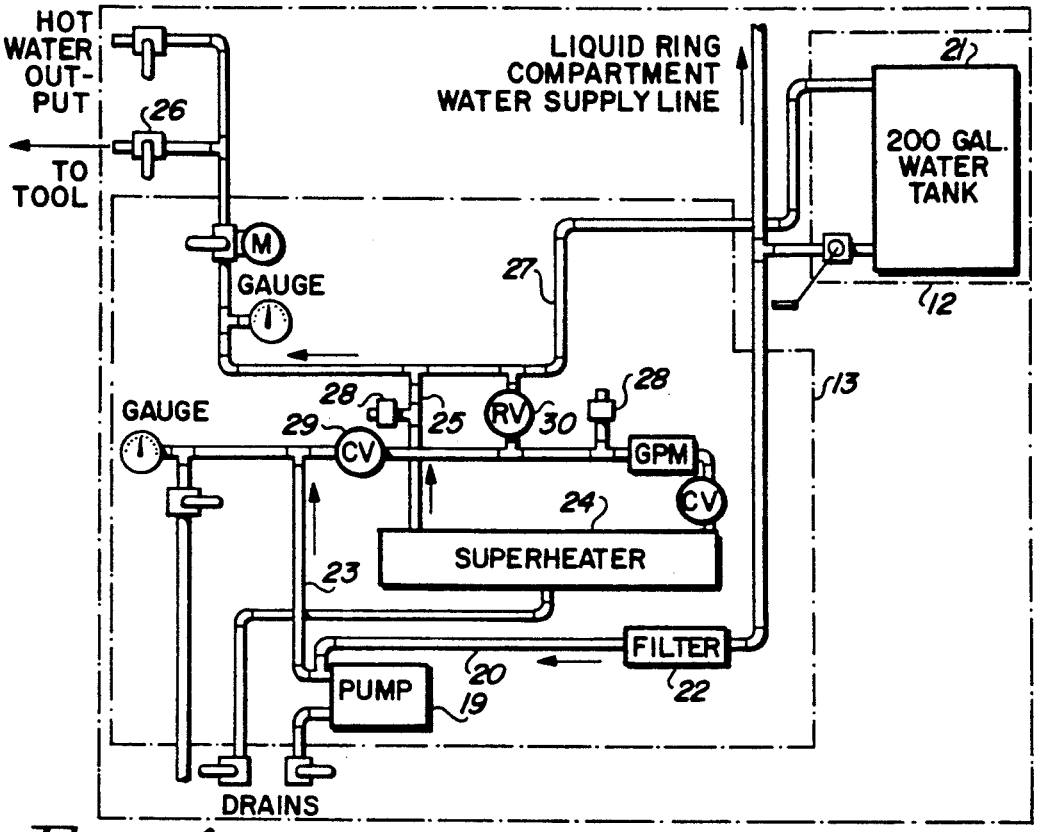
FIG. 4 is a schematic view of the fluid control compartment.

To achieve the ultimate in wet/vacuum cleaning it is required that the cleaning liquid be superheated and pressurized for impact dispensing at blast pressure levels. To accomplish this an arrangement of cooperative elements are housed in compartment 13. Viewing the schematic FIG. 4. illustrating compartment 13., there is disclosed a pump 19, which by a conduit 20 has controlled communication with a liquid supply tank housed in compartment 12. A first filter 22 is placed in this conduit 20 to assure contaminated free liquids entering the pump 19. From the pump 19 the liquid is forced through a conduit 23 into a liquid super heater 24. From the superheater 24 through conduits 25 the heated pressurized liquid is entrained to an output valve 26. A recirculating path consisting of the conduit 25 and conduit 27 permits a controlled recirculation of the heated liquids to tank 21. All of these flow paths are controlled by pressure switches 28, and check and relief valves 29 and 30 respectively. This system assures a superheated cleaning fluid supply rated to provide temperatures up to 300 degrees F., at 1-5 GPM, with pressures of 1,000+PSI at dispensing locations.

To achieve the necessary net/vacuum recovery of the spent cleaning liquid there is employed a liquid ring vacuum pump 31 housed in compartment 16.

Figure 6:
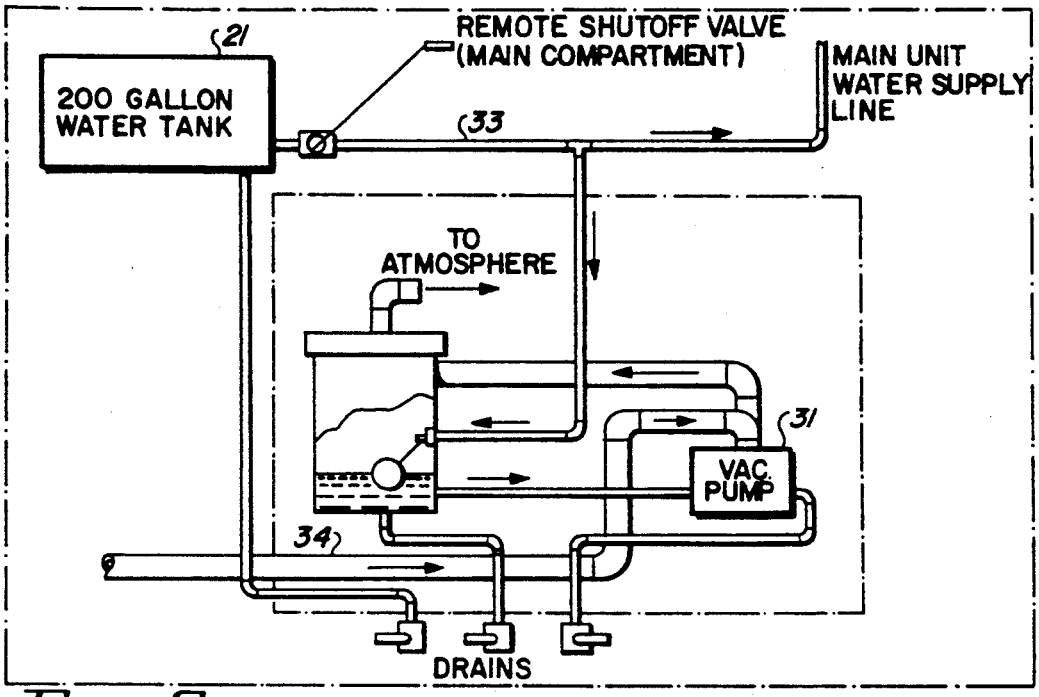
FIG. 6 is a schematic view showing components of the vacuum creating liquid ring pump.

As shown in tile schematic FIG. 6, the liquid ring vacuum pump 31 functions in cooperation with a water supply tank 32, which by a conduit 33, extending between compartment 16 and the tank 21 maintains a proper level of operating liquid within the pump 31. When in operation the liquid ring vacuum pump 31 creates a suction through a recovery hose 34 that is in direct communication with the liquid/particle separation tank 35 housed in compartment 15. The vacuum created by the pump 31 will exit the pump 31 through a hose 36 that is in communication with the water supply tank 32 wherein the entrained fluids are filtered before exiting into the atmosphere through outlet 37.

The described vacuum creating system produces 1,000 CFM at a negative pressure up to 18" Hg., through 400'+ vacuum hose.

Figure 5:
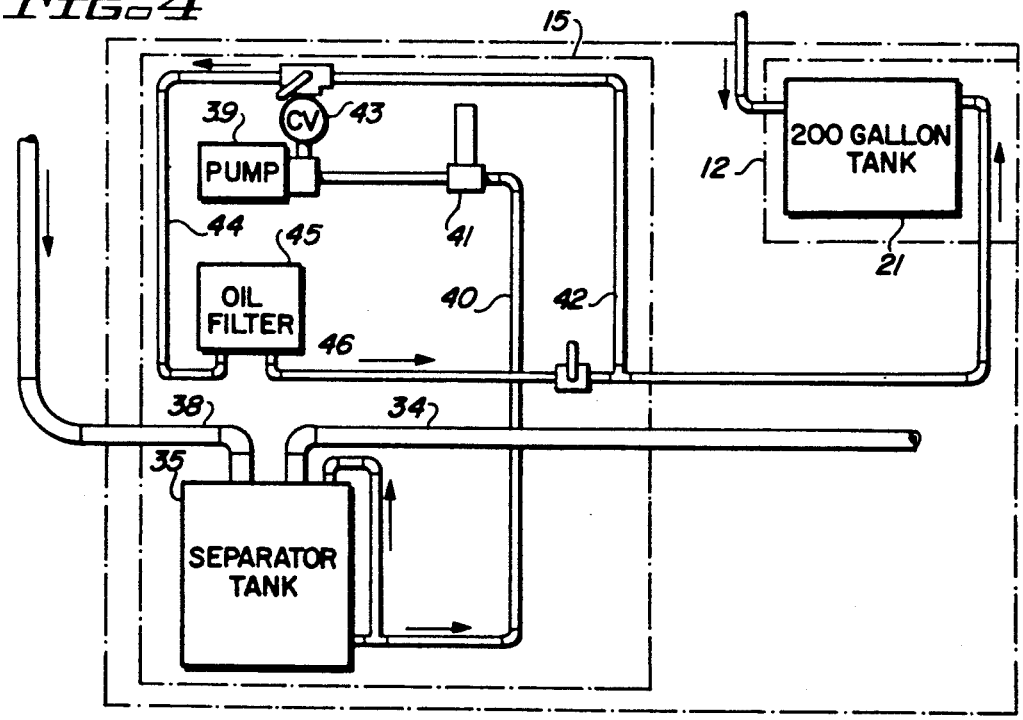
FIG. 5 is a schematic view of the liquid separator compartment as shown in perspective in FIG. 3.

Through the hose 34, which extends between compartments 15 and 16, the liquid ring vacuum pump 31 is in communication with a particle/liquid separator tank 35 housed in compartment 15, (see FIGS. 3 and 5). The tank 35 through a vacuum recovery hose 38 has open communication with a remote cleaning tool (not shown) through which the superheated pressurized spent cleaning liquid, and the dirt and the contaminates are recovered. The tank 35 may be of the cyclone type construction combined with a demister/hepa filter. This tank 35 segregates the spent cleaning liquid from the solid waste and any liquid and/or air borne particles.

As one of the principle objects of this invention is to provide an environmentally safe self-contained retrieval cleaning apparatus, it is of extreme importance that the spent contaminated cleaning fluid be completely filtered as it is to be contained within the apparatus and recirculated through a continuous cleaning process, thus minimizing waste volume.

The segregated liquid, by a recirculating pump 39 will be drawn from tank 35, through conduit 40, and a final filter element 41, and returned to the tank 21 through conduit 42 that extends between the compartments 12 and 15. In the event that the apparatus of this invention is employed to clean oil, ink or dye spills, the pump 39 will draw the spent filtered liquid through conduit 40, and by way of a then open three-way valve 43, into conduit 44, and through an oil filter 45 before being recirculated through conduits 46 and 42 to the supply tank 21.

As an example of the versatility of the self-contained cleaning apparatus of this invention, there is shown in FIGS. 7 through 10 a portable cleaning tool 47 designed for remote use with the apparatus. This cleaning tool 47 is primarily a rock cleaner and is housed in compartment 18 of the vehicle 10. It is adapted to be connected to the cleaning fluid dispensing and retrieval system of the apparatus through an umbilical-like hose 38.

The rock cleaning tool 47 consists of a cart 48 and is supported on a pair of wheels 49 and a fixed stand 50. Within the cart 48 is rotatably mounted an auger type tumbler 51. The tumbler 51 provides circumferentially extending support rings 52 and 53. These support rings 52 and 53 will in turn ride on a series rollers 54. These rollers 54 shown in FIGS. 9 and 10 are diametrically arranged on support rods 55 which rods 55 have their ends journaled in bearings 56 fixedly mounted on the interior walls of the cart 48.

A power source 57 includes a driven gear 58 that through a pulley 59 drives a tooth gear 60 fixedly mounted on one end of the tumbler 51. When energized the power source 57 through the pulley 59 rotates the tumbler 51 within the cart 48.

The tumbler 51 is tubular in structure and is equipped internally with a series oil fins 61 arranged in auger-like fashion. Communicating with tile interior of the tumbler 51 is a vacuum intake hose 62. The external end of the hose 62 supports a suitable pick up nozzle type tool not shown. A deflector flange 63 is mounted on the inner end of the intake hose 62 and is adapted to deflect the suctioned rocks into the tumbler 51.

A cleaning fluid manifold 64 extends inwardly of the tumbler 51 through its opposite open end, and provides a series of dispensing nozzles 65 through which the heated pressurized cleaning fluid from the vehicle is introduced with a blast type impact upon the rocks ingested into the tumbler 51. The manifold 64 through a suitable conduit 66 is connected to the output valve 26.

Adjacent the far closed end 67 of the cart 48 there is a opening 68 which is normally closed by a vacuum responsive door 69 that is hinged as at 70 to the end 67 of the cart 48. Adjacent to the opening 68 and extending at an angle so as to terminate at the exit end of the tumbler 51 is a fine screen flange 71. To one side of the screen flange 71 is a exhaust chamber 72 having open communication with an exhaust port 73 that in turn is adapted to receive one end of the umbilical-like hose 38 (see FIG. 10).

The operation of the rock cleaner 47 commences with the negative vacuum being created within the cart 48 by the actuation of the liquid ring vacuum pump 31 housed in compartment 16 of the vehicle 10. This vacuum being the range of 1,000+ CFM will through a suitable pick up tool vacuum contaminated fairly large, hand size, rocks and gravel through hose 62 and into the tumbler 51. Simultaneously with the deposit of the recovered rocks and gravel pressurized superheated cleaning fluid from the circulating pump 19 and super heater 24, located in compartment 13, is introduced through nozzles 65 thus cleaning the rocks and gravel within the tumbler 51. The auger-like fins 61 will move the rock and gravel through the tumbler 51 and deposit them onto the screen flange 71 and against the door 69. The removed contaminations as well as the spent cleaning fluid will pass through chamber 72 out the port 73 and through the umbilical-like hose 38 back to the liquid particle filtering system housed in compartment 15 of the vehicle 10.

The recovery vacuum may be periodically interrupted such that it no longer maintains the door 69 in a closed position but permits the door to be hingedly opened under the weight of the cleaned rocks or gravel deposited there against, permitting the same to be dispensed from within the cart 48.

Figure 11:
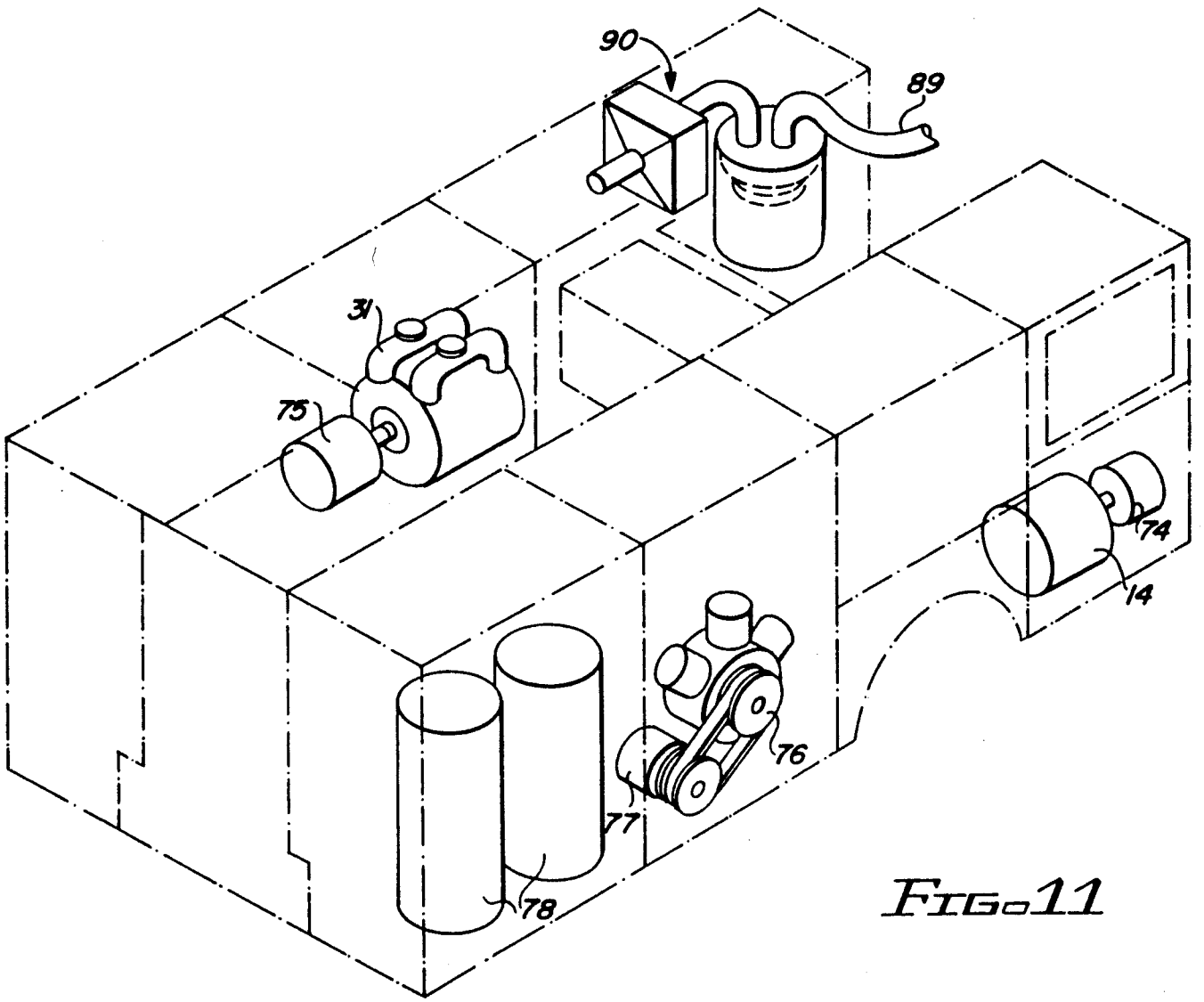
FIG. 11 is a fragmentary schematic view of a modified mobile platform for the invention.

FIG. 11 schematically illustrates a modified compartmentalized housing for replacement elements utilized in the cleaning and retrieval system. In the modified system the potter driven elements such as the generator 14 and the liquid ring pump 31 may be driven by hydraulic motors 74 and 75 respectively. An air compressor 76 driven by an hydraulic motor 77, and associated air tank 78 may be housed in appropriate compartments of the vehicle.

Figure 12:
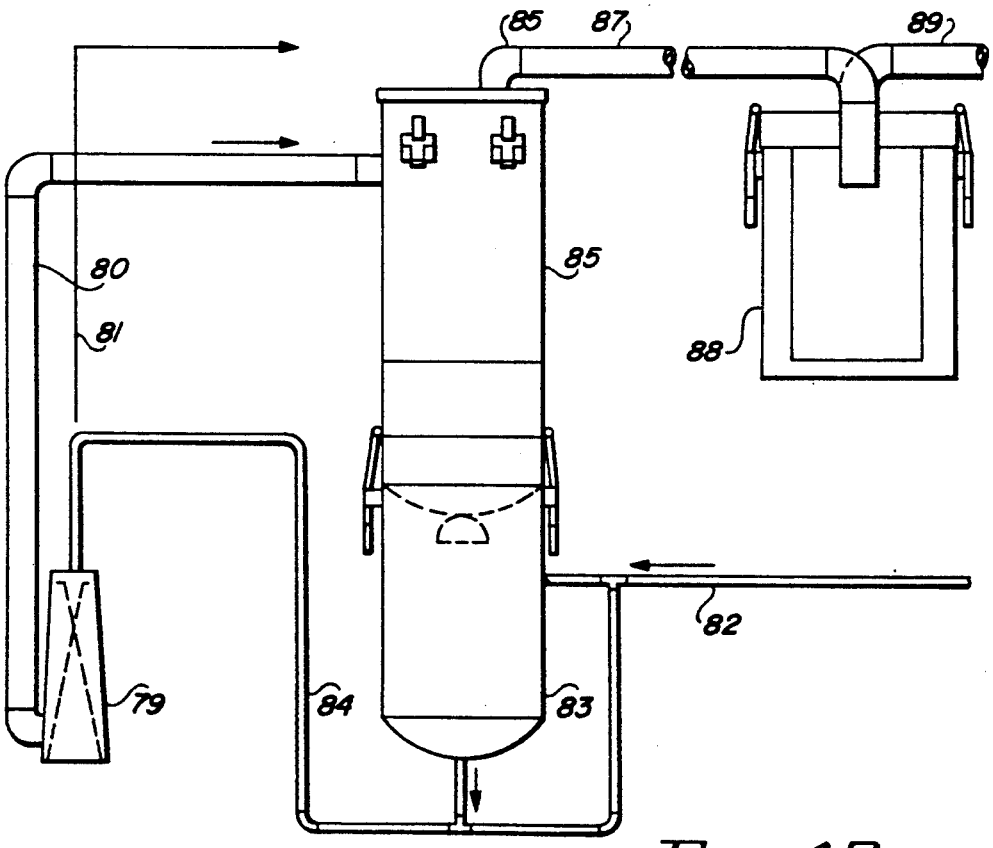
FIG. 12 is a schematic view of a spray vacuum abrasive system associated with the invention.

Adapted to be utilized with the modified housing is a liquid/abrasive spray vacuum system as shown in FIG. 12. A spray vacuum/abrasive blast tool 79 is in communication with a vacuum recovery hose 80 and through conduit 81 a liquid supply.

Air pressure is created by the hydraulic air compressor 76 and is entrained through conduit 82 into an abrasive pressurized supply tank 33. Through conduit 84 the pressurized abrasive is forced from tank 83 to the spray vacuum abrasive blast tool 79.

The spent abrasives, liquid and removed medium is recovered from the tool 79 through a vacuum hose 80 and enters a first stage liquid/abrasive separator tank 85. In such separator tank 85 the abrasive material is separated from the spent liquid and returned to the supply tank 83. The spent liquid, under continuous vacuuming, will exit the first stage separator 85 through outlet 86 and through conduit 87 be drawn through a second liquid abrasive separator 88. From the second stage separator the resulting liquid and air borne particles are drawn through vacuum hose 89 and into the filtering system 90 as identified in FIG. 11.

The modified system may be a individually and independently operated cleaning and retrieval system, or may be an addition to the system shown in FIGS. 1 and 2. The use of air compressor 76 establishes the necessary blast pressure required at the tool 79 for the successful abrasive removal of the unwanted contaminates. To assure the system to be environmentally safe, the liquid spray used in conjunction with the abrasives utilized in tool 79, will entrap and retain all air borne contaminates generated by the abrasive cleaning action.

In the event the system of FIGS. 11 and 12 is used in conjunction with the system illustrated in FIGS. 1 and 2, the vacuumed spent liquid and any air borne particles drawn from the second liquid abrasive separator 88, will be vacuumed through hose 38 into the liquid separator 35 housed in compartment 15 (see FIG. 5). The liquid supplied to the abrasive tool 79 will be obtained through the output valve 26 of the heating and pumping system housed in compartment 13, (see FIG. 4).

From the foregoing it is readily apparent that the apparatus of this invention through the mobile vehicle 10 may be employed in remote areas away from power and water sources such as electrical sub-stations, power installations as well as remote beach areas wherein the rock cleaning tool 47 may be utilized with the vehicle retrieving and capturing the waste contamination for proper disposal.

The vehicle 10 may be utilized in lead paint removal from exposed structures such as bridges, without the necessity of encapsulating the work area during operation. Being self-contained and self-supporting the lead paint removal can be accomplished with complete environmental protection. By being highly mobile the apparatus may be rapidly deployed to perform the cleaning and retrieval operation for which it was designed.

In summary the apparatus of this invention provides a superheated liquid spray cleaning action that is hotter than steam cleaners and which produces blast impact of a pressure washer. The spray vacuum cleaning apparatus recovers the solid waste and superheated cleaning liquid, leaving no residue contamination. Through its powerful wet/dry vacuum system all recovery of the spent cleaning fluid and contaminations are directly contained in disposable containers. The system recovers, filters and recirculates the cleaning fluid used thus minimizing waste volume.

While I have illustrated and described the preferred form of construction for carrying my invention into effect, this is capable of variation and modification without departing from the spirit of the invention. I therefore do not wish to be limited to the precise details of construction as set forth, but desire to avail myself of such variations and modifications as come within the scope of the appended claims.

Having thus described my invention what I claim as new and novel and desire to protect by Letters Patent is:

1. A self-contained cleaning apparatus including cleaning tools that dispense and vacuum spent cleaning liquid and unwanted debris, waste and contaminants from remote surfaces being cleaned, wherein the improvement comprises:

a) a platform-like body, b) means dividing said body into separate compartments, c) a cleaning liquid supply tank in one of said compartments, d) means in another of said compartments for heating and pumping cleaning liquid from said tank to a remote cleaning tool, e) means in a different compartment for creating a vacuum for the recovery of spent cleaning liquid and debris, waste and contaminants from the surface being cleaned, f) means in yet another compartment separating and filtering the vacuumed spent cleaning liquid from recovered solid wastes, g) a remote cleaning liquid dispenser and wet/-vacuum recovery tool in communication with said cleaning liquid heating and pumping means and said separating and filtering means, and h) means providing cooperative inter-connections between said compartments consisting of a conduit circuit between said tank in said one compartment and said separating and filtering means in said yet another compartment, and other conduits between said tank in said one compartment and said liquid heating and pumping means in said another compartment, and different conduits between said vacuum creating means in said different compartment and said separating and filtering means in said yet another compartment, with said remote cleaning liquid dispenser and vacuum recovery tool having a cord-like connection with said heating and pumping means in said another compartment and said separating and filtering means in said yet another compartment.

2. A self-contained automated cleaning and retrieval apparatus as defined by claim 1 wherein said means in a different compartment for creating a vacuum for the recovery of spent cleaning liquid and debris, waste and contaminants from the surface being cleaned comprises a liquid ring pump.

3. A self-contained automated cleaning and retrieval apparatus as defined by claim 1 wherein said means in yet another compartment for separating and filtering the vacuumed spent cleaning liquid from recovered solid wastes consists of a liquid/particle separator and filter.

4. A self-contained automated cleaning and retrieval apparatus as defined by claim 3 wherein said means in a different compartment for creating a vacuum for the recovery of spent cleaning liquid and debris, waste and contaminants from the surface being cleaned comprises a liquid ring pump.

5. A self-contained automated cleaning and retrieval apparatus as defined by claim 4 wherein said remote cleaning liquid dispenser and wet/vacuum recovery tool comprises a portable rock cleaning tool.

6. A self-contained automated cleaning and retrieval apparatus as defined by claim 1 wherein said remote cleaning liquid dispenser and wet/vacuum recovery tool comprises a portable rock cleaning tool.

7. A self-contained automated cleaning and retrieval apparatus as defined by claim 6 wherein said means in a different compartment for creating a vacuum for the recovery of spent cleaning liquid and debris, waste and contaminants from the surface being cleaned comprises a liquid ring pump.

8. A self-contained automated cleaning and retrieval apparatus as defined by claim 6 wherein said means in yet another compartment for separating and filtering the vacuumed spent cleaning liquid from recovered solid wastes consists of a liquid/particle separator and filter.

9. A self-contained automated cleaning and retrieval apparatus as defined by claim 6 wherein said means in a different compartment for creating a vacuum for the recovery of spent cleaning liquid and debris, waste and contaminants through said portable rock cleaning tool produces 1,000+ CFM at negative pressure up to 18" Hg through 400'+ of vacuum hose.

10. A self-contained automated cleaning and retrieval apparatus as defined by claim 6 wherein said means in another of said compartments for heating and pumping cleaning fluid from said tank to a remote cleaning tool consists of a heater creating liquid temperatures up to 300 degree F. and said pumping means producing flow rates and pressure in the range of 1-5 GPM and 1,000+ PSI.

11. A self-contained automated cleaning and retrieval apparatus as defined by claim 1 wherein said means in another of said compartments for heating and pumping cleaning fluid from said tank to a remote cleaning tool consists of a heater creating liquid temperatures up to 300 degree F. and said pumping means producing flow rates and pressure in the range of 1-5 GPM and 1,000+ PSI at the dispensing end of said remote cleaning liquid dispenser.

12. A self-contained automated cleaning and retrieval apparatus as defined by claim 1 wherein said means in a different compartment for creating a vacuum for the recovery of spent cleaning liquid and debris, waste and contaminants through said remote liquid dispenser wet/vacuum recovery tool produces 1,000+ CFM at negative pressure up to 18" Hg through 400'+ of vacuum hose.

13. A self-contained automated cleaning and retrieval apparatus as defined by claim 12 wherein said means in another of said compartments for heating and pumping cleaning fluid from said tank to a remote cleaning tool consists of a heater creating liquid temperatures up to 300 degree F. and said pumping means producing flow rates and pressure in the range of 1-5 GPM and 1,000+ PSI.

14. A self-contained automated cleaning and retrieval apparatus as defined by claim 1 wherein said platform-like body includes a mobile vehicle.

15. A self-contained automated cleaning and retrieval apparatus as defined by claim 1 wherein said remote cleaning liquid dispenser and wet/vacuum recovery tool comprises a spray/vacuum abrasive tool including an abrasive recovery and recycling system.

16. A self-contained automated cleaning and retrieval apparatus as defined by claim 15 wherein said means in a different compartment for creating a vacuum for the recovery of spent cleaning liquid and debris, waste and contaminants from the surface being cleaned comprises a liquid ring pump.

17. A self-contained automated cleaning and retrieval apparatus as defined by claim 15 wherein said means in yet another compartment for separating and filtering the vacuumed spent cleaning liquid from recovered solid wastes consists of a liquid/particle separator and filter.

* * * * *